United States Patent [19]

Chenevard

[11] Patent Number: 4,677,808

[45] Date of Patent: Jul. 7, 1987

[54] ASSEMBLY FOR ASSORTED PACKINGS WITH DIFFERENT PRODUCTS

[75] Inventor: Alexis Chenevard, Morges, Switzerland

[73] Assignee: Sapal, Societe Anonyme des Plieuses Automatiques, Ecublens, Switzerland

[21] Appl. No.: 922,831

[22] Filed: Oct. 22, 1986

[63] Continuation of Ser. No. 708,972, Mar. 7, 1985, abandoned.

[30] Foreign Application Priority Data

Mar. 15, 1984 [CH] Switzerland ..... 1294/84

[51] Int. Cl.[4] ..... B65B 5/00

[52] U.S. Cl. ..... 53/238; 53/240; 53/251; 198/588; 414/753; 901/7

[58] Field of Search ..... 53/154, 157, 155, 534, 53/156, 237, 238, 240, 246, 251; 414/70, 110, 71, 226, 77, 744 A, 744 B, 753; 901/7, 16; 198/369, 588

[56] References Cited

U.S. PATENT DOCUMENTS

| | | | |
|---|---|---|---|
| 2,988,237 | 6/1961 | Devol | 901/7 X |
| 3,444,982 | 5/1969 | Greiner | 414/77 X |
| 3,456,424 | 7/1969 | Thurston et al. | 53/154 |
| 3,586,176 | 6/1971 | Rackman | 414/71 X |
| 3,760,956 | 9/1973 | Burch | 901/7 X |
| 4,201,937 | 5/1980 | Irie | 901/7 X |
| 4,453,874 | 6/1984 | Veldhuizen et al. | 414/77 X |

*Primary Examiner*—Robert L. Spruill
*Assistant Examiner*—Steven P. Weihrouch
*Attorney, Agent, or Firm*—Frost & Jacobs

[57] ABSTRACT

The assembly comprises several transport bands for advancing the products to be disposed in the preformed containers for assorted packings to a distributing station, from where several band conveyors transport the products to different filling stations. Each filling station comprises a depositing means for the products being mounted on a slewing arm comprising an extensible horizontal arm. The depositing means comprises a tubular stem connected to a coupling piece which in turn is carried by the head of a conveyor thus connecting the conveyor and the slewing arm. The assembly is designed to facilitate the regulations which are necessary for a change of the format of assorted packings.

9 Claims, 4 Drawing Figures

ASSEMBLY FOR ASSORTED PACKINGS WITH DIFFERENT PRODUCTS

Figure 1:
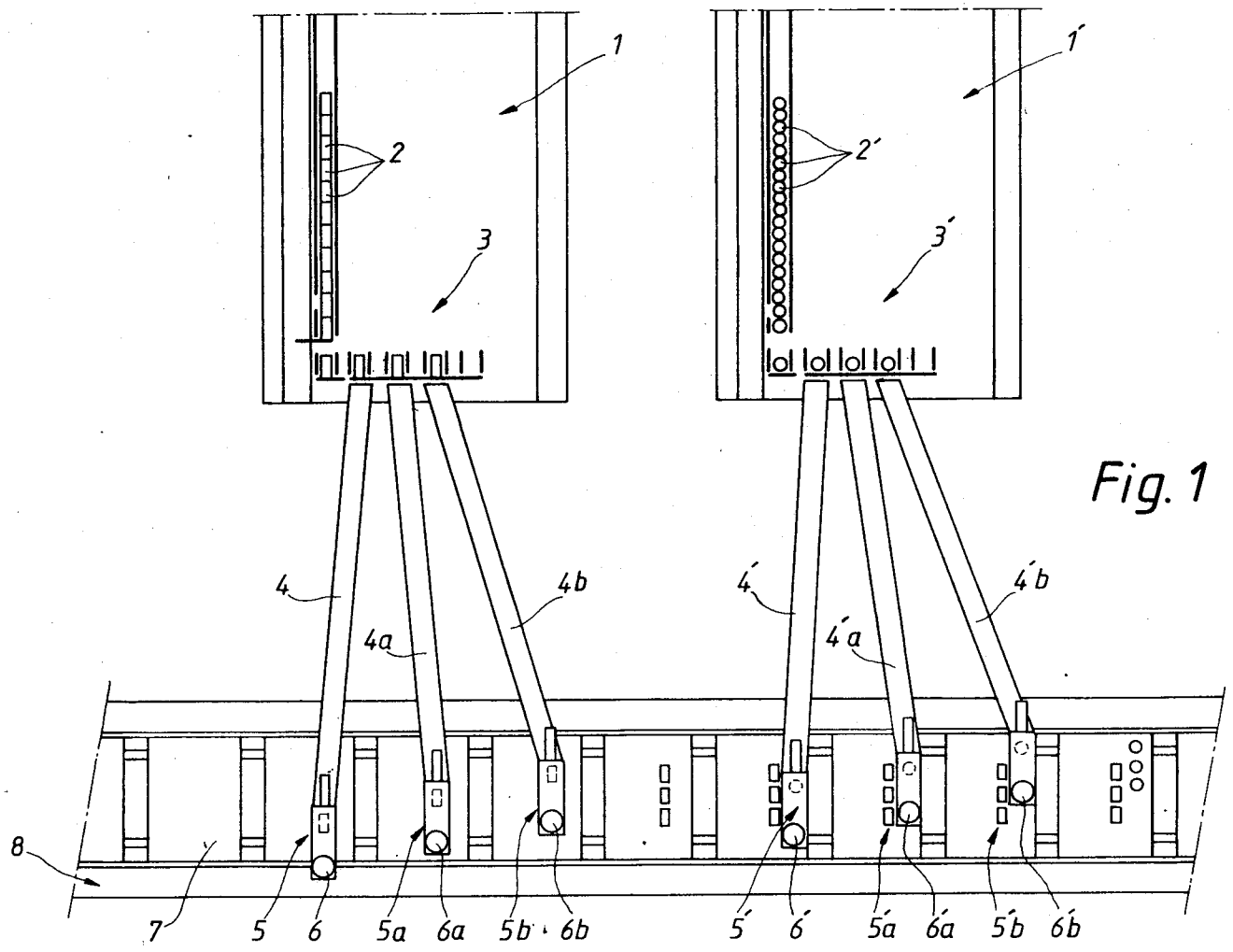

This is a continuation of application Ser. No. 708,972, filed Mar. 7, 1985 now abandoned.

The present invention concerns an assembly for filling preformed containers of assorted packings with different sorts of products, comprising several transport bands for respectively advancing products of a same sort being deposited in a row to a corresponding distributing means, the assembly further comprising at least one band conveyor associated with each distributing means for advancing products of a same sort to a filling station for filling the containers with this sort of products, and a transport means for intermittently advancing the containers to the filling station.

Swiss Pat. No. 584 132 describes an assembly of this type in which several, for example three band conveyors are associated with each distributing means, each one being designed to advance a same sort of products to three different points where they are simultaneously deposited in successive preformed containers, whereby they occupy three different positions in a particular assorted packing. Indeed it is well known to deposit several products of the same sort at different locations in a particular assorted packing which may for instance comprise chocolates. An installation for automatically boxing chocolates comprises generally the same number of transport bands as the number of sorts of chocolates to be deposited in th box and to each transport band are generally associated three or four conveyors designed to deposit three or four chocolates of the same sort at different locations in each box. Several variations are of course possible, for example two or more transport bands could be supplied with products of the same sort, or the number of conveyors associated to each transport band may be varied, and so forth.

Since these assemblies are very expensive it is essential for the utilizer to exploit them as far as possible, that means to utilize them for all filling operations of assorted packings whatever will be the box format, the number and the nature of different sorts of products or their distribution within the box.

Until today, the change from one format to an other or a modification of the distribution of the contents in th box required a plurality of regulation steps which were relatively expensive in view of the necessary technician time and the dead time of the assembly. All members which are designed to cooperate for the transport and the deposition in the containers, in particular the band conveyors and the means for depositing products, being independent, a precise adjustement of their respective positions required very difficult operations.

The present invention proposes to eliminate this inconvenience in realizing an assembly for which the adjustments according to changes of the format of the assorted packings or modifications of the distribution of the products within the packing may be carried out in a very rapid and simple manner which requires only a short dead time.

To this effect, the assembly according to the invention is characterized by the filling station comprising a depositing means for depositing the products, which is mounted on slewing arm, and by the conveyor band being associated with each distributing means being extensible and pivotingly mounted at its one end adjacent to the distributing means on a fixed pivot, such that the other end or head adjacent to the depositing means and the depositing means itself may be moved together, to reach each point of an area covering at least the surface of a preformed container which is previously positioned in the filling station.

Figure 2:
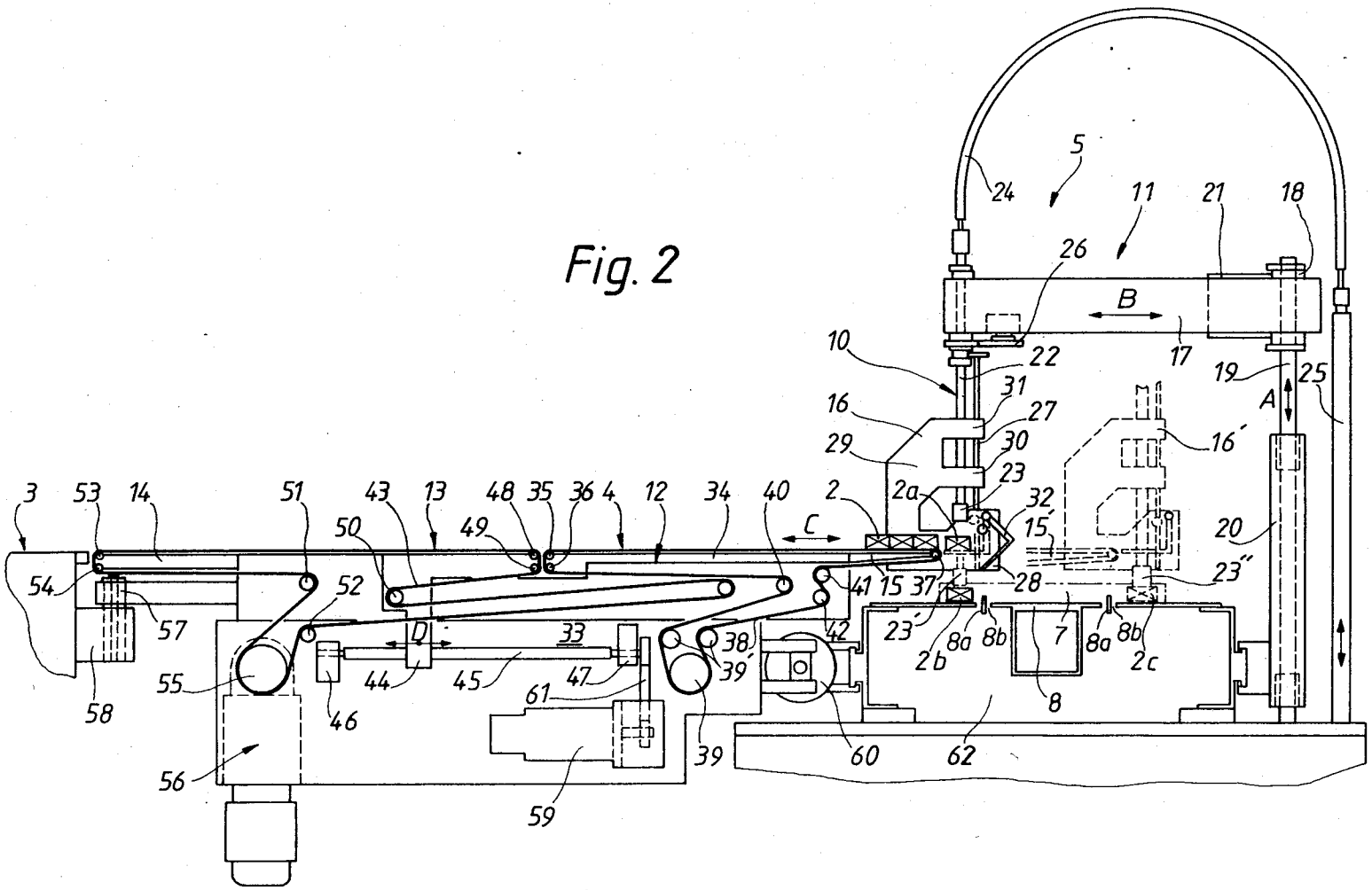
Figure 3:
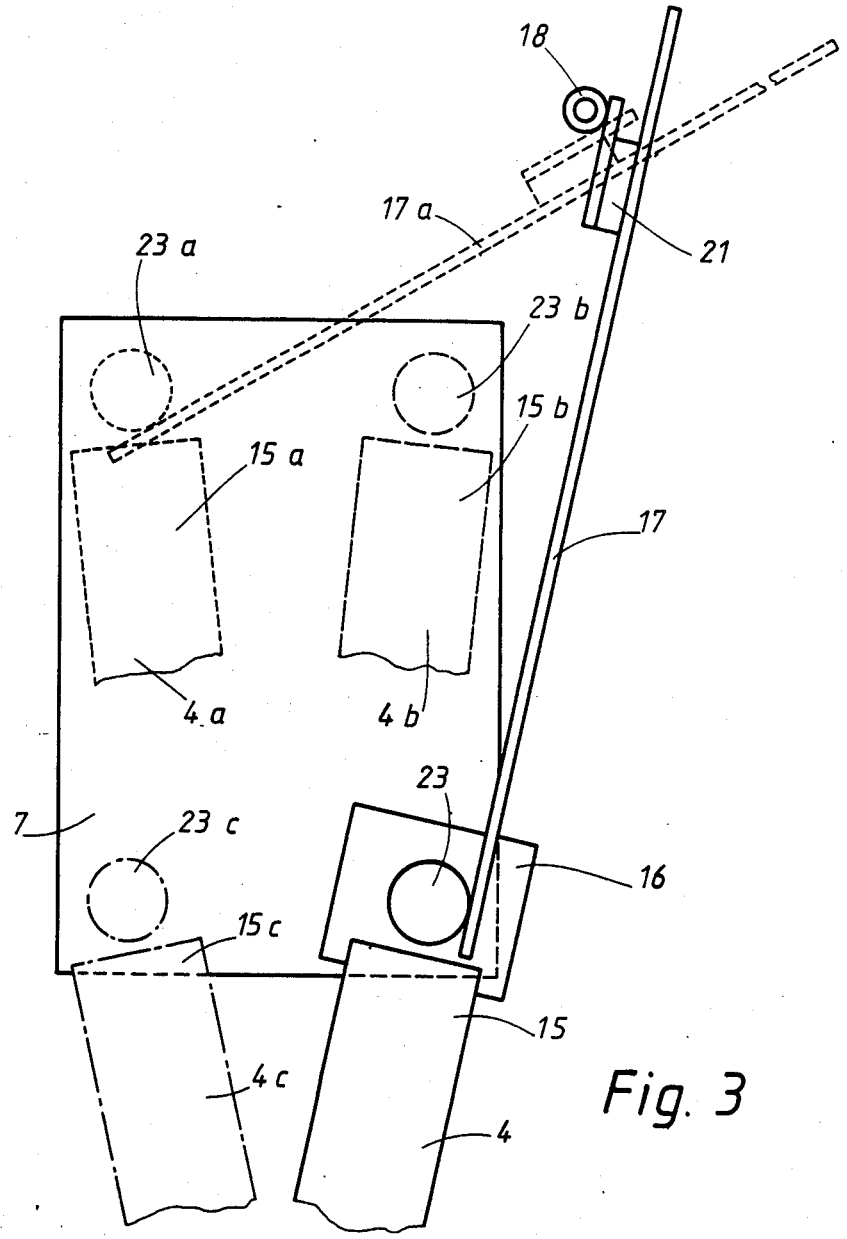
Figure 4:
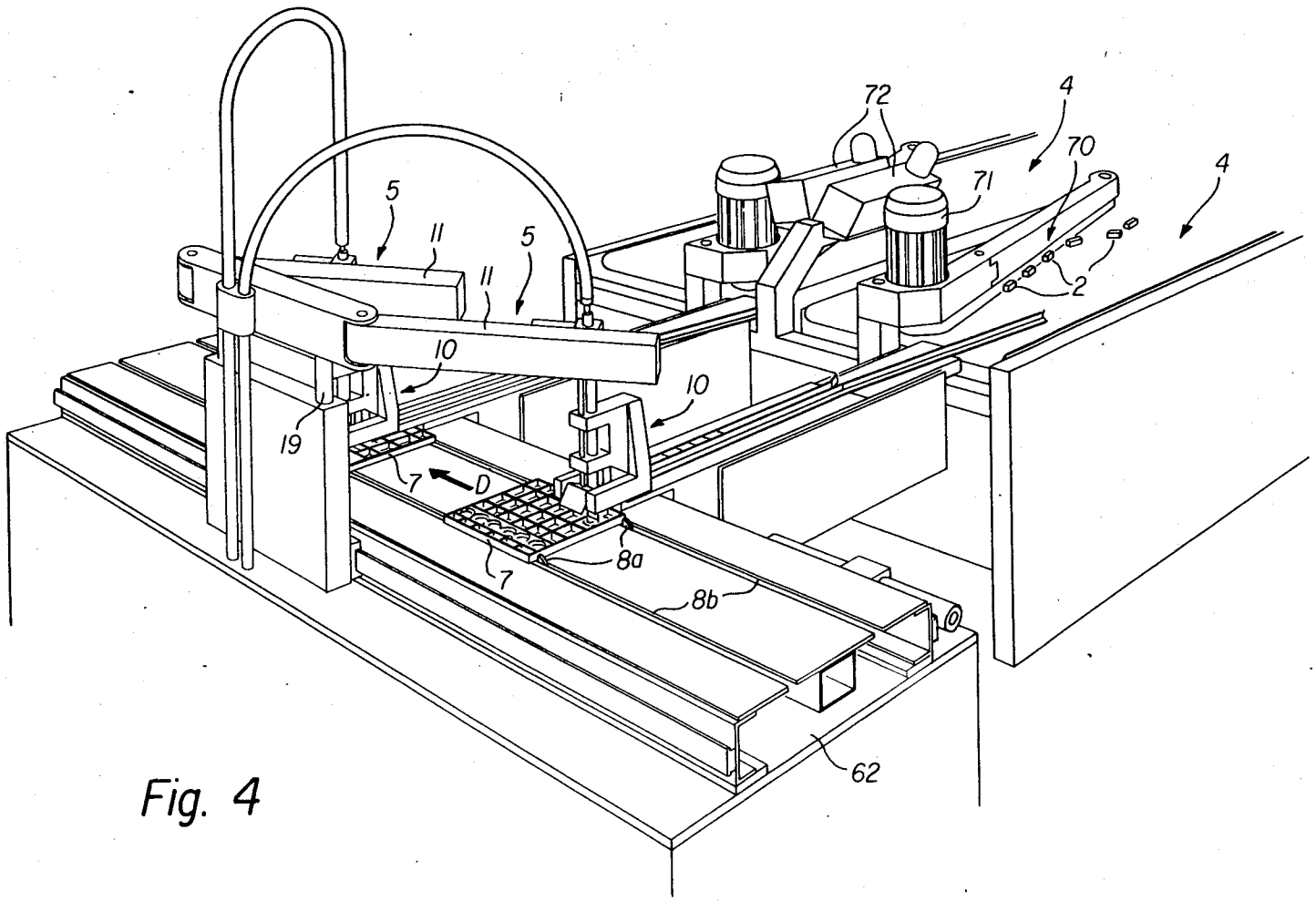

The present invention will be better understood with reference to the description of an embodiment of the invention and the accompanying drawings, wherein:

FIG. 1 represents a schematic view illustrating the functional principle of an assembly according to the invention, FIG. 2 represents a schematic side elevational view of the assembly according to the invention, FIG. 3 represents a partial top view illustrating different possible positions of the means for depositing the products within the preformed containers, and FIG. 4 is a perspective view of the installation such as partially represented in elevation by FIG. 2.

FIG. 1 represents an assembly comprising a series of transport bands whereof only the first two 1 and 1' are represented, and which serve for advancing products of different sorts 2 and 2' respectively disposed in a row to distributing means 3 and 3' being arranged at the ends of the transport bands. To each of this distribution means is associated at least one, preferably several for example three band conveyors 4, **4*a*, 4*b* and 4', 4'*a*, 4'*b* to advance the products 2 and 2' respectively to different filling stations 5, 5*a*, 5*b* and 5', 5'*a*, 5'*b***.

The filling stations comprise gripping means such as for example suction nipples 6, **6*a*, 6*b* and 6', 6'*a*, 6'*b* to take the advanced products from the band conveyor and dispose them in preformed containers 7 which are intermittently advanced on a transport means 8 provided with an intermittently working transport comb designed to advance the containers successively through the filling stations of the assembly. The transport comb comprises schematically represented fingers 8*a* (FIG. 2) which move vertically and horizontally within longitudinal grooves 8*b* of the transport means 8**.

The above description which refers to FIG. 1 may correspond to known types of installations as well as to the new assembly, particularities thereof being described now with reference to FIG. 2.

FIG. 2 represents essentially a filling station, for example station 5 of FIG. 1, and a corresponding band conveyor 4. The filling station comprises means 10 for depositing the products 2 in a preformed container 7 driven by the fingers **8*a* of the transport means 8. This means 10 is arranged on a slewing arm 11 which will be described in more details in the following. The band conveyor 4 is composed in the present case of two elements 12 and 13 which are arranged one in the prolongation of the other. The upstream end 14 of the element 13 is disposed immediately adjacent to the distribution means 3 and the downstream end 15 of the element 12 is arranged immediately adjacent to the means 10 for depositing the products in the containers 7. The means 10 and the downstream end 15 of the element 12, which is called in the following the head of the band conveyor 4, are connected by a coupling piece 16 which in fact is supported by the head of the band conveyor 4**.

The slewing arm 11 is composed of a horizontal arm 17, one end of which is supported by a joint 18 fastened to a column 19 being axially movable in the direction of the double arrow A, wherein the column 19 is guided by a hollow cylinder 20. The arm 17, which is pivotable in a horizontal plane due to the joint 18, is extensible in the direction of the double arrow B. This arm is composed of two elements which are connected by a connecting member such as for example a ball-bearing 21 being schematically represented.

The means 10 for depositing the products in the containers 7 comprises a tubular stem 22 the free end of which carries the gripping means which may be constituted for example by the suction nipples 23. The aspiration which permits to grasp a product is effected through the tubular stem 22, a flexible conduit 24 and a second tubular stem 25 which is connected to a non represented vacuum pump. A driving mechanism 26 which is known per se and schematically represented ensures the rotational movement of the tubular stem 22 and consequently of the suction nipples 23 which is necessary for positioning the product 2 in the desired orientation within the container 7. A full stem 27 cooperates with the tubular stem 22 in order to guide the coupling piece 16.

This coupling piece comprises a base 28, a vertical support 29 and two arms 30 and 31. The base 28, by which the guiding member is connected to the support of the band conveyor 4, further supports a swing lever 32 and its non represented control mechanism. The swing lever 32 is designed to support the product 2*a* disposed at the head of the row until the product is taken off by the suction nipple 23. The two arms 30 and 31 cooperate to guide the tubular stem 22 and the full stem 27 of the means 10. The vertical support ensures the connection between the base 28 and the arms 30 and 31.

The conveyor 4 comprises a frame 33 which serves to support the different components of the conveyor. These components comprise in particular a movable table 34 carrying rolls 35, 36 and 37 between which extends the horizontal and straight part of an endless band 38 representing the element 12 of the band conveyor 4. Furthermore, the band 38 being driven by a driving roll 39 is stretched by rolls 40, 41 and 42 being fastened to the frame 33 and passes further on two reversing rolls 39' which are arranged adjacent to the driving roll 39. This arrangement permits to move the element 12 in the direction of the double arrow C to advance the head of the band conveyor in the extreme front position 15' which is partially represented in dashed lines. The translational movement of the table 34 does not require any modification of the length of the band 38.

The element 13 comprises a band 43 and a support the back portion of which is constituted by the frame 33, the front portion being constituted by a part of the table 34 of the element 12. This table 34 comprises an arm 44 designed to cooperate with a screw spindle 45 connected to the frame 33 by two bearings 46 and 47, such that it may be moved and thereby move the table 34 in the direction of the double arrow D. The band 43 is stretched by a series of rolls whereof rolls 48, 49 and 50 are carried by the movable table 34 and others, in particular rolls 51, 52, 53 and 54, are carried by the frame 33. A driving roll 55 which is coupled to a reduction motor 56 is equally mounted on the frame 33.

The frame 33 is articulated on a pivot 57 being mounted on a support block 58 which is carried by the support of the transport band 1. This pivot 57 permits the angular movement of the band conveyor 4 together with all members which are fixed to the conveyor.

Even though the different movements as designed above in particular the extension of the band conveyor 4 in the direction of the double arrow C, the extension of the horizontal arm 17, the rotation of the conveyor 4 around the pivot 57 and the rotation of the horizontal arm 17 around the joint 18 may be carried out manually, mechanization of these movements is provided in order to obtain full automatization for the change of the format of the assorted packings, the arrangement of the products or the structure of the containers.

To this end, the frame supports two electric motors 59 and 60, one of which 59 is mounted on the frame 33 and coupled to one end of the spindle 45 by a gear system 61. The rotation of this spindle produces a displacement of the arm 44 in one direction or the other, that means a movement of the table 34 in direction of the double arrow C. The motor 60 is mounted on the support 62 of the intermittently advancing transport comb 8. The latter is designed such that it creates a movement of the front end of the table 34 in a direction perpendicular to the drawing plane, that is a slewing motion of the band conveyor 4 around the pivot 57. These motors permit to move the head 15 of the conveyor in two directions being essentially perpendicular to each other. Since the table is connected to the means 10 by the coupling piece 16, its movement in two perpendicular directions produes an identical movement of the means 10 role of which is as mentioned above to deposit the products into the containers 7.

As shown in FIG. 2, a product 2*b* carried by a suction nipple 23' illustrated in its lower position is deposited at the left side of the container 7 when the head 15 of the conveyor band 4 and the coupling piece 16 occupy there respective positions illustrated in full lines. The product 2*c* carried by the suction nipple occupying the position 23'' is desposited at the right side of the container 7 when the head 15 occupies the position 15' and when the coupling piece 16 occupies the position 16', both positions 15' and 16' being represented in dashed lines.

It is clear that this second position of the head 15 and of the coupling piece 16 corresponds to a not represented telescopic retraction of the horizontal arm 17 and eventually to a slewing motion of this arm and/or a slewing motion of the conveyor 4 around the pivot 57.

The changes of position which permit the means 10 to scan an area covering at least the surface of the container 7 are illustrated in FIG. 3. The joint 18 comprises a ball-bearing 21 which in turn carries the arm 17. The free end of the arm 17 carrying the suction nipple 23, and the head 15 of the band conveyor 4 are coupled by the coupling piece 16 as illustrated schematically. In a first position as illustrated in full lines, the band conveyor on one hand and the arm 17 on the other hand are oriented and lengthwise adjusted such that the products may be deposited in the right front angle of the container 7. A second position as illustrated with pointed lines shows the arms 17*a* which is partially withdrawn in direction to the joint 18, which permits the suction nipple 23*a* to take the products from the head 15*a* of the band conveyor 4*a* to deposit them in the right back angle of the container 7. Two other positions 15*b*, 23*b* and 15*c*, 23*c* of the head of the band conveyor 4*b*, 4*c* and of the suction nipple are illustrated in dashed lines and in mixed lines repsectively illustrated in this figure. It is clear that all intermediary positions are also accessible.

In practice the assembly comprises a programmable control unit which may be programmed originally from the producer or from the user and which contains all necessary data for controlling the entirety of operations which are requested for change of the format of the assorted packings or the arrangement of the products and/or the nature of the contents of the packing. Thus a selection of a program by means of a non represented switch or any other control means permits to automatically transmit the appropriate signals to the motors 59 and 60 in order to have them turned a predetermined number of rounds which corresponds to the desired movement of the head 15 of the band conveyor 4. As mentioned previously this movement engages a similar movement of means 10 due to the existence of the coupling piece 16, which brings the suction nipple 23 in the required position to deposit the product 2 at the desired location within the container 7.

By a single command which consists in selecting a program, it is thus possible to modify selectively in the entire assembly the positions of all means 10 for depositing the products in the containers, which means 10 are connected to the respective band conveyor 4 and the slewing arm 11.

The change of program is consequently considerably facilitated. Furthermore, the motors are in this embodiment only operated for changes of the format and during small periods such that their life time is increased.

FIG. 4 shows a part of a filling line comprising two stations 5 such as described with reference to FIG. 2. This view shows the profile of the support 62 on which the preformed containers 7 are moved by the fingers 8*a* which are engaged in the grooves 8*b*, thereby permitting to push the containers in the direction of the arrow D.

The means 10 for depositing the products in the preformed containers 7 is carried by a corresponding slewing arm 11, the horizontal arm 17 of which is pivotingly arranged on the column 19. The positioning of this arm may be operated manually or by all kind of other mechanical or pneumatic means which are controlled by the programmation unit.

Each conveyor 4 for advancing the products 2 is equipped with guides for positioning and correctly aligning the products. These guides comprise at least one lateral band 70 driven by a motor 71. The controls units 72 which are schematically represented permit to switch on and off the means for positioning the products.

I claim:

1. An assembly for filling preformed containers of assorted packings with different kinds of products, comprising several rigidly fixed transport bands for respectively advancing products of a same kind disposed in a row to corresponding distributing means, at least one belt conveyor associated with each distributing means for advancing the products of a same kind to a filling station for filling the containers with this kind of products, and transport means for intermittently advancing the containers to said filling station, and filling station comprising depositing means for gripping and removing the products from the belt conveyor and depositing the products in said containers wherein the belt conveyor associated with each said distributing means is extensibly and pivotally mounted at a first end adjacent said distributing means on a fixed pivot, and wherein a second end of said belt conveyor remote from said distributing means carries said depositing means, whereby said second end and said associated depositing means are movable together in two directions essentially perpendicular to each other to reach any point of an area covering at least the surface of a preformed container which has been previously positioned in the filling station.

2. The assembly of claim 1, wherein said second end of each belt conveyor is fixed to a coupling piece which in turn is connected to the depositing means for the products such that a movement of said second end produces automatically an identical movement of the depositing means.

3. The assembly of claim 2, wherein said belt conveyor includes a first and a second element disposed one in the prolongation of the other and wherein said elements are connected to a movable table designed to carry out an axial movement of the first element and a corresponding extension or retraction of said second element.

4. The assembly of claim 3, wherein said movable table is fixed to a frame which is articulated on a pivot fastened to a support block which is carried by a support of said transport band.

5. The assembly of claim 4, including two motors, one of which being designed for moving the movable table with respect to said frame, the other one being designed to swing the frame around said pivot such that the head of the belt conveyor moves in the direction of movement of an intermittently working transport comb for the containers.

6. The assembly of claim 5, including a programmable control unit designed to control simultaneously all the motors corresponding to each belt conveyor, such that the depositing means are simultaneously positioned into a selected position corresponding to a particular format of the packing or a particular arrangement or distribution of the products therein.

7. The assembly of claim 6, wherein said control unit comprises at least one switch for selecting a desired program.

8. The assembly of claim 1, wherein the depositing means for the products comprises a tubular stem carrying a suction nipple and a slewing arm supporting said stem, said slewing arm comprising a horizontal arm pivotally borne on a vertical axially movable column.

9. The assembly of claim 8, wherein said tubular stem is engaged in a boring provided across at least a part of the coupling piece such that said stem may freely slide within the boring.

* * * * *